US008653921B2

(12) United States Patent
Fuchs

(10) Patent No.: US 8,653,921 B2
(45) Date of Patent: Feb. 18, 2014

(54) ELECTROMAGNET

(75) Inventor: Patrik Fuchs, Kirkel (DE)

(73) Assignee: Hydac Electronic GmbH, Saarbrücken (DE)

( * ) Notice: Subject to any disclaimer, the term of this patent is extended or adjusted under 35 U.S.C. 154(b) by 0 days.

(21) Appl. No.: 13/261,484

(22) PCT Filed: Mar. 23, 2011

(86) PCT No.: PCT/EP2011/001428

§ 371 (c)(1),
(2), (4) Date: Oct. 22, 2012

(87) PCT Pub. No.: WO2011/144272

PCT Pub. Date: Nov. 24, 2011

(65) Prior Publication Data

US 2013/0069745 A1 Mar. 21, 2013

(30) Foreign Application Priority Data

May 21, 2010 (DE) ..... 10 2010 021 175

(51) Int. Cl.
*H01F 3/00* (2006.01)
*H01F 7/08* (2006.01)

(52) U.S. Cl.
USPC ..... 335/255; 335/262; 335/270; 335/281

(58) Field of Classification Search
USPC ..... 335/255, 262, 270, 281
See application file for complete search history.

(56) References Cited

U.S. PATENT DOCUMENTS

| | | | | |
|---|---|---|---|---|
| 7,209,020 | B2 * | 4/2007 | Telep | 335/255 |
| 2002/0060620 | A1 | 5/2002 | Bircann | |
| 2010/0123535 | A1 | 5/2010 | Yamagata et al. | |

FOREIGN PATENT DOCUMENTS

| | | | |
|---|---|---|---|
| DE | 42 01 448 | A1 | 7/1993 |
| DE | 43 26 838 | A1 | 2/1995 |
| DE | 44 36 616 | A1 | 4/1996 |
| DE | 195 02 158 | A1 | 8/1996 |
| EP | 1 818 951 | B1 | 8/2009 |
| FR | 2 552 582 | | 3/1985 |
| GB | 1 074 843 | | 7/1967 |

* cited by examiner

*Primary Examiner* — Ramon Barrera
(74) *Attorney, Agent, or Firm* — Roylance, Abrams, Berdo & Goodman LLP

(57) ABSTRACT

An electromagnet, in particular a switching magnet, has a field winding (11) located on a coil former (7), and has a pole piece (23) forming a part of the magnetic return path. A pole core (17) and an axially movable magnetic piston (19) are provided within the coil former (7). The pole piece (23) forms an aperture opening (25) for the magnet piston (19) on the area opposite the pole core (17). The magnet piston (19) is borne for its movement in its guide in the pole core (17). The pole piece (23) has a flange part (27) at least partially engaged over the coil former (7) at its axial end, and has a bush part (29) which extends axially from it. Within the coil former (7), the pole piece forms a hollow cylinder engaged over a longitudinal section of the magnet piston (19). Between the inner wall of the hollow cylinder and the circumference of the magnet piston (19), a parasitic air gap (30) is formed.

5 Claims, 3 Drawing Sheets

ELECTROMAGNET

FIELD OF THE INVENTION

The invention relates to an electromagnet, in particular a switching magnet, having a field winding located on a coil form. A pole piece forms a part of the magnetic return path. A pole core and an axially movable magnetic piston are provided inside the coil form. The pole piece forms an aperture opening for the magnetic piston on the region opposite the pole core. The magnetic piston is mounted in a guide of the pole core in order to move said magnetic piston.

BACKGROUND OF THE INVENTION

An electromagnet of this kind is known from document EP 1 818 951 B1. The magnetic return path between the pole piece and the magnetic piston are of considerable importance for the operating properties of such magnets. The property of this return path depends on the configuration of the air gap located between the magnetic piston and the pole piece. Generally, a small air gap between the magnetic piston and the pole piece results in an increase in the magnetic force over stroke. This document discloses a number of solutions for the geometric design of the air gap that are based on measures for shaping the magnetic piston on its end adjacent to the aperture opening on the pole piece. These solutions involve tapered surfaces at the end section of the piston or a shortening of the length of the piston in such a way that its end surface does not totally extend through the aperture opening.

SUMMARY OF THE INVENTION

An object of the present invention is to provide an electromagnet that is distinguished by a comparatively improved magnetic force/stroke characteristic.

The invention basically achieves this object with an electromagnet having a parasitic air gap that is the determining factor for the operating properties of the electromagnet is formed such that the pole piece, connected to a flange part, which partially extends over the axial end of the coil form, forms a bushing part, which extends into the coil form in the form of a hollow cylinder and extends over a longitudinal section of the magnetic piston. A parasitic air gap is then formed between the inner wall of the hollow cylinder and the circumference of the piston. The difference between the inside diameter of the hollow cylinder of the bushing part and the outside diameter of the piston is chosen in such that the gap width can be adjusted to an optimal value. In contrast to the solutions disclosed in the state of the art, there is no change whatsoever in the gap geometry when the piston moves, so that the objective of an optimal force/stroke characteristic can be met.

In especially advantageous exemplary embodiments, the magnetic piston is mounted with a sliding fit on a guide sleeve being coaxial relative to the hollow cylinder of the pole piece that has such a tight tolerance that the magnetic piston is not brought into contact with the hollow cylinder when the width of the parasitic air gap is less than 0.1 mm. Friction due to the contact made between the magnetic piston and the pole piece would result in an increase in the hysteresis in the magnetic force/stroke characteristic. Such contact must then be avoided under all circumstances. Since the invention provides a tightly toleranced coaxiality of the guide in the pole core and the guide sleeve, there is the possibility of minimizing the width of the parasitic air gap without having to accept the risk of contact.

In an especially advantageous embodiment, the arrangement can be configured in such a way that a second pole piece, which is designed as the identical part of the first pole piece, is disposed on the region opposite the aperture opening. The second pole piece forms with its bushing part the tight fit for the pole core mounted in the hollow cylinder. The use of two pole pieces that are identical in construction offers the possibility of reducing the unit price by twice the number of items, so that the end product can be manufactured in an efficient and economical way.

With respect to the design of the rest of the magnetic return path, the arrangement can be configured in such an advantageous way that a magnetic return casing, which at least partially surrounds the winding, forms a magnetic return path to the flange part of the pertinent pole piece. Such exemplary embodiments are distinguished by a high magnetic force compared to the small size.

An especially efficient and economical production is made possible by exemplary embodiments, wherein in order to form a tight unit, the coil form, the pole piece, and the return casing are encapsulated by injection molding with a plastic encapsulating compound that forms a uniform housing.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
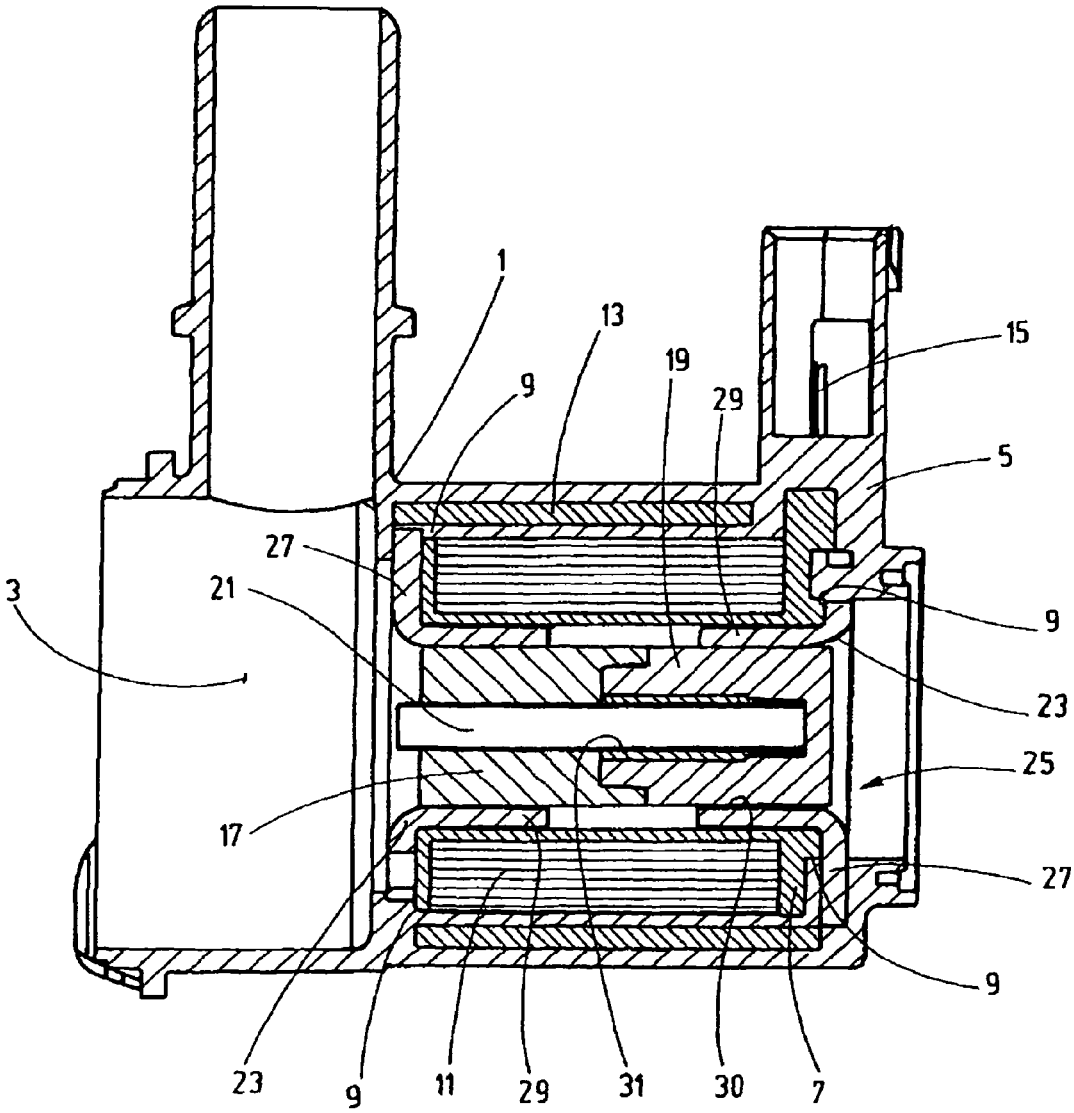
FIG. 1 is a side elevational view in section of a switching electromagnetic according to a first exemplary embodiment of the invention, wherein a valve device, which may be found in the housing and can be actuated by an actuating plunger of the electromagnet, has been omitted for the sake of a better overview.

The invention is explained below by one example, where the electromagnet inside a housing 1 forms the actuating element for a valve device, which is arranged in a valve chamber 3 in the housing 1. This valve device has been omitted in the drawing because it is not a part of the invention. The housing 1 is formed as an integral component made of a plastic encapsulating compound 5, with which the coil form 7 and the other components of the electromagnet are encapsulated by injection molding.

Figure 3:
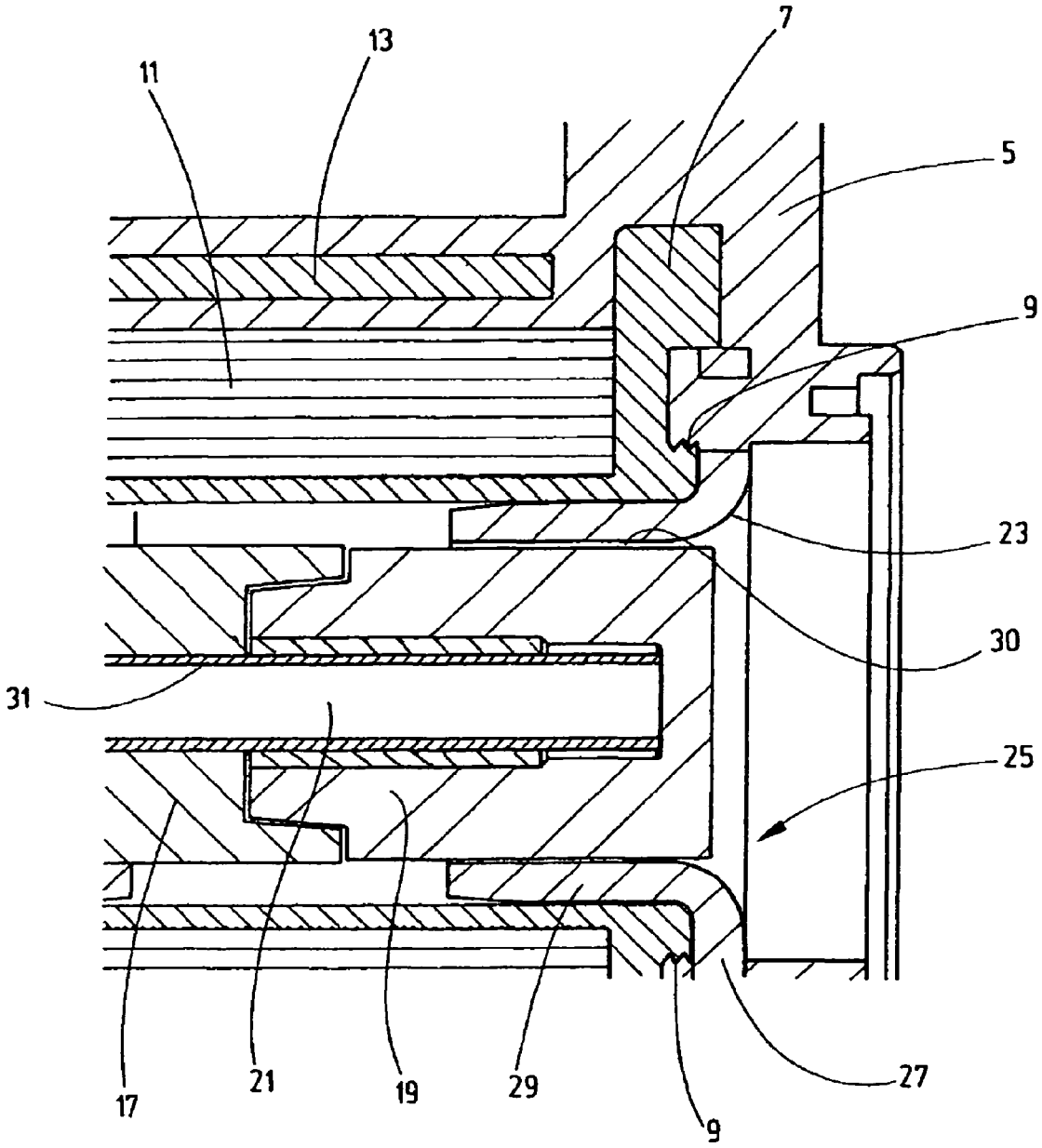
FIG. 3 is an enlarged, partial side elevational view of the region adjacent to the magnetic piston of FIG. 1.

In order to guarantee a gas tight connection between the encapsulating compound and the coil form during the process of encapsulation by injection molding, the coil form 7 is provided, as shown more clearly in the enlarged drawing in FIG. 3, with serrations 9 that form the so-called fused edges during the process of encapsulation by injection molding. The field winding 11, which may be found on the coil form 7, is surrounded by a return casing 13, forming a part of the magnetic return path, in the conventional manner for such electromagnets. This return casing is embedded, just like the flat plugs 15, used to supply the winding 11 with current, in the encapsulating compound 5.

On the region facing the valve chamber 3, there is a rigidly mounted pole core 17 inside the coil form 7. A magnetic piston 19 is arranged so that it can be moved axially relative to the pole core in the interior of the coil form 7. In the drawings from FIGS. 1 and 3, the magnetic piston 19 is shown in the position of its stroke end brought closer to the pole core 17. At this stroke end, a guide sleeve 21, which interacts with the magnetic piston 19 and which can accommodate an actuating plunger (not shown in detail), which is provided for the control of the valve device (not illustrated), may be found in its position located the furthest to the left in the drawing. If it involves a so-called "pushing" electromagnet, then this position of the piston corresponds to the totally energized state of the field winding 11. Otherwise, the magnetic piston 19 can be moved to the right from the illustrated end position by supplying current.

For the continuation of the magnetic return path from the return casing 13 into the interior of the coil form 7, there are pole pieces 23, which are constructed as identical parts. Of these pole pieces, a first pole piece 23 forms an aperture opening 25 in the region of the magnetic piston 19; and the magnetic piston 19 can be moved inside this aperture opening. Each of the pole pieces 23 has a flange part 27, which extends over the facing axial end of the coil form 7 in such a way that it extends as far as into the vicinity of the return casing 13. A bushing part 29 extends from the flange part 27 into the interior of the coil form 7. The bushing part 29 forms a hollow cylinder, which extends over a longitudinal section of the piston 19 at the first pole piece 23 and over a longitudinal section of the pole core 17 at the second pole piece 23. In this longitudinal section of the second pole piece 23, the pole core 17 is secured in place by a tight fit. The inner wall of the hollow cylinder at the first pole piece 23 may be found at a distance from the circumference of the magnetic piston 19, but in a small parasitic air gap 30, so that the gap width is less than 0.1 mm. In the present exemplary embodiment, the difference between the outside diameter of the magnetic piston 19 and the inside diameter of the hollow cylinder of the bushing part 29 is, for example, 0.07 mm.

Figure 2:
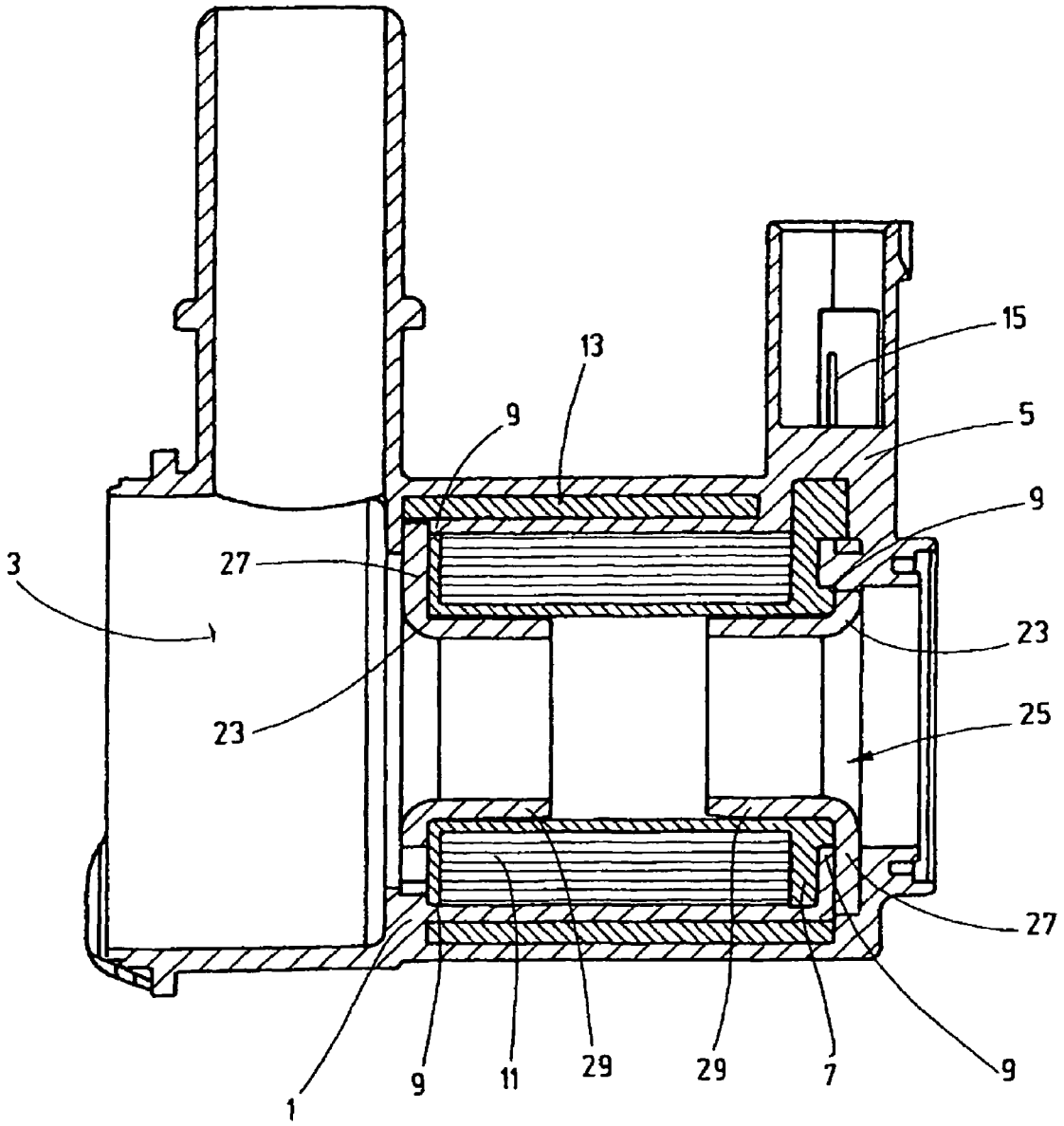
FIG. 2 is a side elevational view in section analogous to FIG. 1, showing the state of the production of the housing by the process of encapsulating the coil form by injection molding, but prior to the incorporation of the pole core and the magnetic piston.

A gap width that is minimized in this way without incurring, as a result, the risk of being brought into contact with the magnetic piston 19, a feature that would result in a higher hysteresis and, thus, a malfunction, can be implemented in the present invention in a reliable way by mounting the magnetic piston 19 together with its guide sleeve 21 in a displaceable manner on the pole core 17 with a sliding fit that is subject to tight tolerances and by maintaining a tightly toleranced coaxiality of the hollow cylinder of both bushing parts 29 of the pole pieces 23. This goal is achieved by using a calibrated encapsulating mandrel (not illustrated) in the interior of the coil form 7 that is still open in FIG. 2 during the encapsulation process, in the course of which the production stage depicted in FIG. 2 is reached. The result is that the coaxiality between the hollow cylinders of the bushing parts 29 of both pole pieces 23 can be kept smaller than 0.07 mm. In this way, a totally pressure tight arrangement for the magnet as a whole is also obtained. Furthermore, FIGS. 1 and 3 also show that a cylindrical guide bushing is also used between the outer circumference of the guide sleeve 21 and the facing inner circumference of the magnetic piston 19. However, this guide bushing does not continue, as shown, completely as far as the bottom of the magnetic piston 19. Furthermore, the guide bushing is held in the magnetic piston 19 by a shoulder-like diminution of the diameter that passes over, when seen in the direction of the figures to the right, into the bottom of the magnetic piston 19, on which the guide sleeve 21 is supported.

While one embodiment has been chosen to illustrate the invention, it will be understood by those skilled in the art that various changes and modifications can be made therein without departing from the scope of the invention as defined in the appended claims.

What is claimed is:

1. A switching electromagnet, comprising:

a field winding located on a coil form;

a first pole piece forming a part of a magnet return path;

a pole core and an axially movable magnetic piston inside said coil form, said magnetic piston being mounted in a guide of said pole core for movement of said magnetic piston;

an aperture opening in said first pole piece for said magnetic piston on a region thereof opposite said pole core;

a flange part on said first pole piece at least partially extending over said coil form;

a bushing part of said first pole piece extending axially from said flange part and forming a hollow cylinder extending over a longitudinal section of said magnetic piston inside said coil form;

a parasitic air gap between an inner wall of said hollow cylinder and a circumference of said magnetic piston; and a guide sleeve coaxial to said hollow cylinder of said first pole piece, mounting said magnetic piston with a sliding fit and having a tight tolerance such that said magnetic piston does not contact said hollow cylinder when said parasitic air gap has a width less than 0.1 mm.

2. A switching magnet according to claim 1 wherein a second pole piece identical to said first pole piece is disposed on a region of said pole core opposite said aperture opening, said second pole piece having a bushing part thereof forming a tight fit for said pole core mounted in said hollow cylinder.

3. A switching electromagnet according to claim 1 wherein a magnetic return casing at least partially surrounds said field winding and forms a magnet return path to said flange part of said first pole piece.

4. A switching electromagnet according to claim 3 wherein said coil form, said first pole piece and said return casing are encapsulated by an injection molding of a plastic compound forming a uniform housing to form a tight unit.

5. A switching electromagnet according to claim 1 wherein an actuating plunger of said magnetic piston is mounted on said pole core over a guideway forming a component of the sliding fit.

* * * * *